United States Patent [19]

Kunkel, Jr.

[11] 4,434,724

[45] Mar. 6, 1984

[54] OVERBED DISTRIBUTOR FOR FEEDING DUAL SOLID FUELS TO A STOKER FURNACE

[75] Inventor: Robert C. Kunkel, Jr., Feeding Hills, Mass.

[73] Assignee: Combustion Engineering, Inc., Windsor, Conn.

[21] Appl. No.: 481,214

[22] Filed: Apr. 1, 1983

[51] Int. Cl.[3] ..... F23H 11/00; F23K 3/16

[52] U.S. Cl. ..... 110/269; 110/267; 110/263; 110/115; 110/327

[58] Field of Search ..... 110/101 R, 111, 115, 110/267, 327, 243–245, 263–265, 287, 288, 292, 293, 269, 270; 406/89, 90; 222/637

[56] References Cited

U.S. PATENT DOCUMENTS

| | | | |
|---|---|---|---|
| 2,163,825 | 6/1939 | Bros | 110/115 |
| 2,187,726 | 1/1940 | Brown | 110/270 |
| 2,228,751 | 1/1941 | Bros | 110/115 |
| 2,386,336 | 10/1945 | Mosshart | 110/269 |
| 2,404,847 | 7/1946 | Kessler | 110/115 |
| 2,476,567 | 7/1949 | Sparks | 110/270 |
| 2,956,527 | 10/1960 | Hopwood | 110/270 |

*Primary Examiner*—Henry C. Yuen

*Attorney, Agent, or Firm*—Robert L. Olson

[57] ABSTRACT

A furnace (10) in which coal and cellulose fuel can both be burned on the same traveling grate (24). First means (36) are provided for introducing coal onto the grate at one end (38), such that it traverses the full grate run before it falls as ash from the other end (56) of the grate. Second means (48, 52) are provided for introducing cellulose fuel onto the grate at a central or middle location (54). Adjustable means (49, 50) are provided for varying the point at which the cellulose fuel is introduced onto the grate. If cellulose fuel having a relatively slow burning rate is being combusted, the adjustable means are set so as to introduce the fuel at a point on the grate further away from the discharge end. If cellulose fuel having a relatively fast burning rate is being combusted, the adjustable means are set so as to introduce the fuel at a point on the grate closer to the discharge end.

4 Claims, 1 Drawing Figure

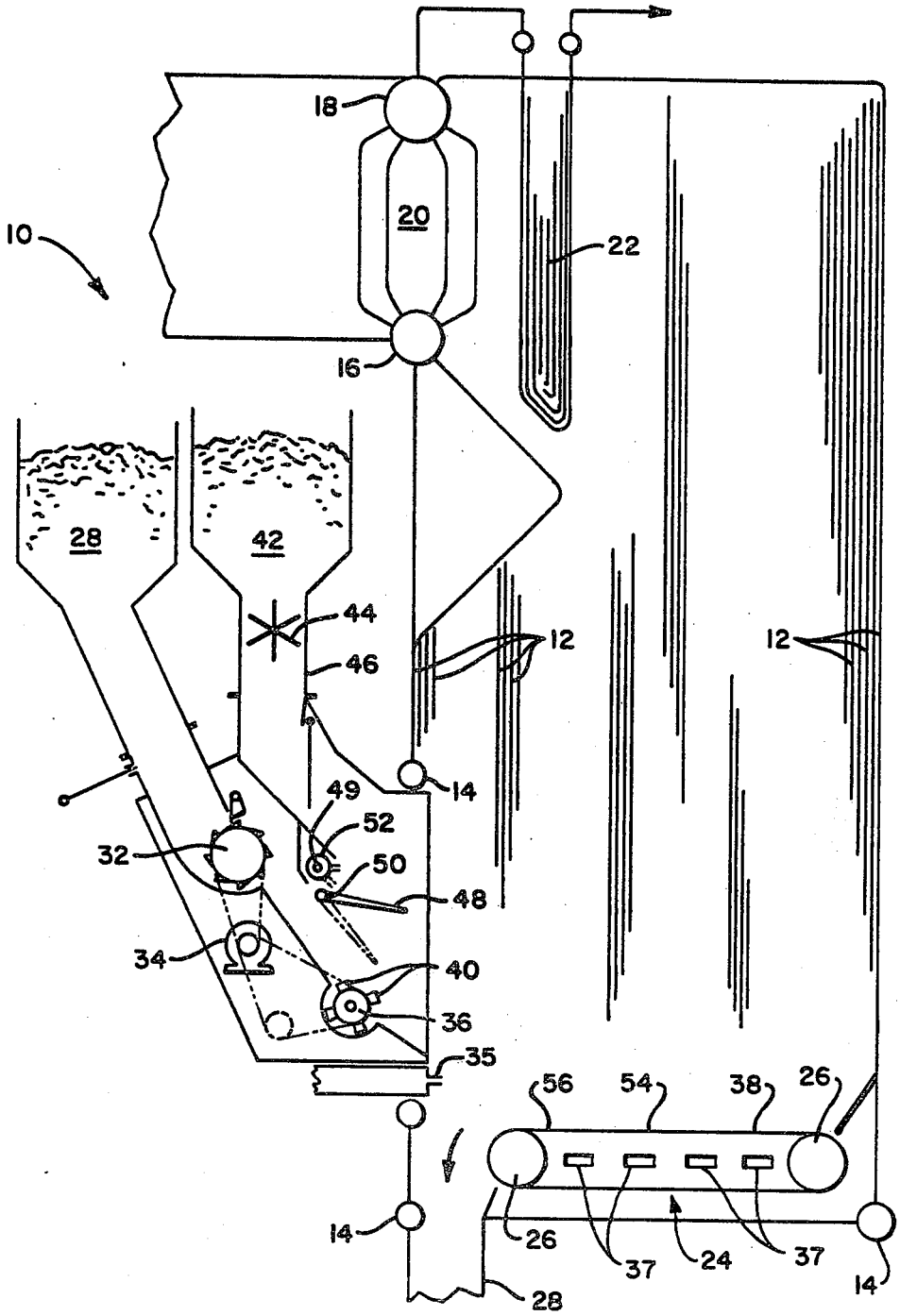
10
18
20
22
16
28
42
44
46
12
12
14
49
52
32
50
48
34
40
36
35
56
54
38
26
14
26
37
24
37
14
28

OVERBED DISTRIBUTOR FOR FEEDING DUAL SOLID FUELS TO A STOKER FURNACE

BACKGROUND OF THE INVENTION

In this day and age, ecology is a high priority item. Where in years past many remnant waste products from industrial operations were indiscriminately discharged into the atmosphere, water, or land dumps, every effort is made today to dispose of such waste products in an ecologically acceptable manner. In doing so, some benefits have been realized. For example, the cellulosic scrap from papermaking or lumber operations used to be left lying at industrial sites in ugly, polluting piles. Today, one economical way to dispose of these waste cellulose products is to burn them, using the heat to generate steam in a steam generator.

In many papermaking or lumber operations, there is insufficient waste product produced to keep a steam generator continuously operating. Or an operation may be seasonal, shutting down or being greatly curtailed during certain periods of the year. In contrast, the efficient use of the steam produced might require continuous and constant production. Thus, it is desirable to use some other fuel in addition to the cellulose waste, and be able to burn them singly or in combination. One such fuel that can be burned in conjunction with the cellulose fuel is crushed coal. The burning rate of crushed coal is generally much slower than that of cellulose waste products. In addition, the burning rate of various cellulose waste products can vary considerably. For example, large pieces of bark or woodchips take considerably longer to burn than sawdust or pieces of paper. Also, the moisture content greatly affects the burning rate. Thus, care must be taken in selecting the manner in which these various fuels can be most efficiently burned in conjunction with a second fuel, such as coal.

SUMMARY OF THE INVENTION

A furnace in which both coal and cellulose fuels are burned, with both fuels being combusted on a traveling grate. A rotating arm member is provided for introducing the coal (which is relatively slow burning), near one end of the grate, so that it traverses the entire furnace bottom before reaching the discharge end in the form of ash and cinders. A platform or plate is also provided from which the cellulose fuel can be discharged, with the aid of high pressure jets of air, onto the middle portion of the grate. The platform is tiltable about one edge and the air jet nozzles are adjustable, so that the position on the grate on which the majority of the cellulose fuel is deposited can be adjusted, depending on the makeup of the fuel.

BRIEF DESCRIPTION OF THE DRAWING

The FIGURE is a sectional side view of a traveling grate furnace which is capable of burning both coal and cellulose fuel therein.

DESCRIPTION OF THE PREFERRED EMBODIMENT

Looking now to the drawing, numeral 10 denotes a furnace in which both coal and cellulose fuel can be burned. The furnace is lined with water-cooled tubes 12 which are supplied by headers 14. The headers receive water from the lower drum 16 through downcomers (not shown). A mixture of steam and water exits from the upper ends of tubes 12 into upper drum 18. Steam is also generated in the boiler section 20 of the unit. The steam passes fom drum 18 to superheater 22 and from there flows to its ultimate point of use.

Looking now to the combustion or firing aspects of the furnace, the fuel is burned on grate 24. The grate travels in a counterclockwise direction by being driven by the forward shaft 26. The speed at which the grate travels is set so that complete combustion of not only the coal but also the cellulose fuel takes place before they are discharged from the end of the grate to shute 28 in the form of cinder and ash.

Coal is fed to the furnace in the following manner. Coal, generally in fairly small pieces after going through some sort of crushing process, is fed from bin 28 to a coal feeder 32. The feeder 32 meters the coal, according to the required or called for coal demand, and the feeder 32 is driven by motor 34 at the required speed. The metered coal falls to a medium RPM spreader wheel 36 which evenly spreads it on the back portion 38 of the grate 24 across its entire width. The coal is thrown to this rear or back part 38 of the grate by means of arms 40 contained on wheel 36. Both the feeder and spreader wheel 36 are driven by the externally mounted motor 34 through a transmission assembly utilizing belts and roller chains for power transmission. Overfire air is supplied through nozzles 35, and underfire air is supplied beneath the grate as indicated by inlets 37.

The cellulose fuel is introduced into the furnace from storage bin 42 through star valve 44 or other metering device. The cellulose fuel falls by gravity through shute 46 onto an adjustable feed plate or platform 48. The plate is adjustable in that it can be pivoted about the edge 50. The fuel is blown off the plate 48 by air from a plurality of high pressure air jet nozzles 52, which are equally spaced across the width of the furnace. The nozzles are pivotable also, about central rod 49, for the purpose to be explained shortly.

The position of the plate 48, and the nozzle 52, and the pressure of the air jets, are all adjusted such that the cellulose fuel is deposited somewhere in the central portion 54 of the grate (either closer to the discharge end or further therefrom). The fuel will be deposited further from or closer to the discharge end 56 depending on the rate of combustion of the fuel being supplied at any particular time. For example, if the majority of the material in bin 42 is light, fast burning material, such as paper products or dry sawdust, then plate 48 would be pivoted so that it lies at a relatively steep angle to the horizontal, as shown in dashed lines. In addition, the nozzles 52 would be set to blow somewhat above the plate so that the full force of the air jets are not directed against the material. Also, a low air pressure is used under these conditions. Thus, the fuel still falls to the grate 24 near its central portion 54, but relatively near to the discharge end 56.

In contrast, if the majority of the material in bin 42 is slow burning, such as pieces of bark or waste wood, then plate 48 is pivoted upwardly, so that it lies horizontal or close thereto, such as shown in full lines in the figure. The nozzles 52 are set to direct the air jets so that a portion thereof will form an air cushion beneath the fuel and the rest blows directly against the fuel particles. Also, the pressure of the air is increased. The above operation will result in the fuel particles being blown outwardly a distance, so that the majority thereof again lands in the central portion 54 of the grate, but nearer the farther end 38. An operator can adjust the plate and air nozzles and air pressure as often as necessary, which may be as often as several times a day, or as little as several times a month, depending on how rapidly conditions change.

I claim:

1. In combination, a furnace for burning coal and cellulose fuel therein, a traveling grate in the furnace bottom having an upper run and a lower run, and also having a first end positioned adjacent a first wall of the furnace, and a second end located adjacent a second opposite wall of the furnace, a discharge shute located beneath the second end of the traveling grate through which ashes fall, means for continuously moving the upper run of the grate towards the second wall, first introduction means for introducing coal onto the grate near the first end, second introduction means for introducing cellulose fuel onto the grate at a central location, said second introduction means including a plate positioned above the second end of the grate, and a plurality of nozzle means supplied with pressurized air, which nozzle means are positioned such that they blow cellulose fuel supplied to the plate off of it onto the grate, and adjustable means for the second introduction means, by means of which the location at which the cellulose fuel is introduced onto the grate can be varied, said adjustable means including means for pivoting the plate so that it can be made to lie at a greater or lesser angle to the horizontal, and said adjustble means also including means for pivoting the nozzle means, so that they direct air jets directly at the cellulose fuel on the plate, or slightly above the fuel.

2. The combination set forth in claim 1, wherein the adjustable means includes means to vary the air pressure being supplied to the nozzle means.

3. The combination set forth in claim 2, including means for supplying the grate with overfire air and underfire air.

4. The combination set forth in claim 3, including means associated with the furnace for generating steam from the combustion gases.

* * * * *